US008516632B2

(12) United States Patent
Ogundare

(10) Patent No.: US 8,516,632 B2
(45) Date of Patent: Aug. 27, 2013

(54) COMFORT QUILT AND PILLOWCASE

(76) Inventor: Beverly L Ogundare, Laurel, DE (US)

( * ) Notice: Subject to any disclaimer, the term of this patent is extended or adjusted under 35 U.S.C. 154(b) by 99 days.

(21) Appl. No.: 13/069,098

(22) Filed: Mar. 22, 2011

(65) Prior Publication Data

US 2011/0265261 A1 Nov. 3, 2011

Related U.S. Application Data

(60) Provisional application No. 61/282,951, filed on Apr. 28, 2010.

(51) Int. Cl.
*A47G 9/00* (2006.01)

(52) U.S. Cl.
USPC ..... 5/485; 5/490; 5/496; 5/417; 5/690

(58) Field of Classification Search
USPC ..... 5/485, 413 R, 482, 490, 417, 419, 5/420
See application file for complete search history.

(56) References Cited

U.S. PATENT DOCUMENTS 1,925,358 A * 9/1933 Wittcoff ..... 5/419
2,845,637 A 8/1958 Di Stefano
3,638,251 A * 2/1972 Weiss ..... 5/485
5,438,719 A * 8/1995 Anthony ..... 5/485
5,548,858 A * 8/1996 Shoa ..... 5/413 R
5,784,733 A 7/1998 Rasamny et al.
5,991,945 A 11/1999 Pang
6,049,925 A * 4/2000 Lewis ..... 5/497
7,051,386 B2 * 5/2006 Stewart et al. ..... 5/413 R
7,243,385 B2 7/2007 Lampkins
7,584,515 B2 * 9/2009 Jones et al. ..... 5/485
7,600,279 B1 * 10/2009 Cameron ..... 5/482
7,975,334 B1 * 7/2011 Vensel ..... 5/498
8,096,009 B2 * 1/2012 Shelby ..... 5/690

* cited by examiner

*Primary Examiner* — Peter M Cuomo
*Assistant Examiner* — Brittany Wilson
(74) *Attorney, Agent, or Firm* — Richard C. Litman

(57) ABSTRACT

The comfort quilt and a pillowcase combination has features that permit easy and efficient cleaning thereof. The quilt incorporates a housing or cover member that encapsulates an insert therein. The insert includes plastic sheathing that is stuffed with a soft insulating material. When the quilt is soiled, the insert is easily removed from the cover member so that the cover member can be cleaned (wash and dried). An electronic device (battery operated) is attached to the insert for emitting spiritual music or prayers for comfort. The pillowcase includes a facing member attached thereto. The facing member can be easily removed from the pillowcase.

4 Claims, 4 Drawing Sheets

COMFORT QUILT AND PILLOWCASE

CROSS-REFERENCE TO RELATED APPLICATION

This application claims the benefit of U.S. Provisional Patent Application Ser. No. 61/282,951, filed Apr. 28, 2010.

BACKGROUND OF THE INVENTION

1. Field of the Invention

The present invention generally relates to bedding accessories, and particularly to a comfort quilt and pillowcase combination that is especially adapted for use by the elderly and/or infirm.

2. Description of the Related Art

There are many instances when an elderly and/or infirm person is in need of an extra amount of comforting that a caregiver cannot provide because of other duties and time constraints or the like. In such instances, the person in need of comforting is left to wallow in despair and can be devoid of hope. It would certainly be advantageous if an accessory were available to provide a modicum of comforting relief at these times. The advantages would be further enhanced if the accessory could be easily cleaned when necessary. Thus, a comfort quilt and pillowcase combo solving the aforementioned problems is desired.

SUMMARY OF THE INVENTION

The comfort quilt and pillowcase is drawn to a bedding set combination having features that permit easy and efficient cleaning thereof. The quilt incorporates a housing or cover member that encapsulates an insert therein. The insert comprises a plastic sheathing that is stuffed with a soft insulating material. When the quilt is soiled, the insert is easily removed from the cover member so that the cover member can be cleaned (wash and dried). An electronic device (battery operated) is attached to the insert for emitting spiritual music or prayers for comfort. The pillowcase includes a facing member attached thereto. The facing member can be easily removed from the pillowcase. This arrangement allows the facing member to be removed for cleaning, thereby obviating the need to clean the entire pillowcase.

Accordingly, the invention presents a quilt, pillowcase combination that provides warmth and comfort to elderly or infirm individuals in the absence of a caregiver. The combination has removal and detachable features that permit easy cleaning. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
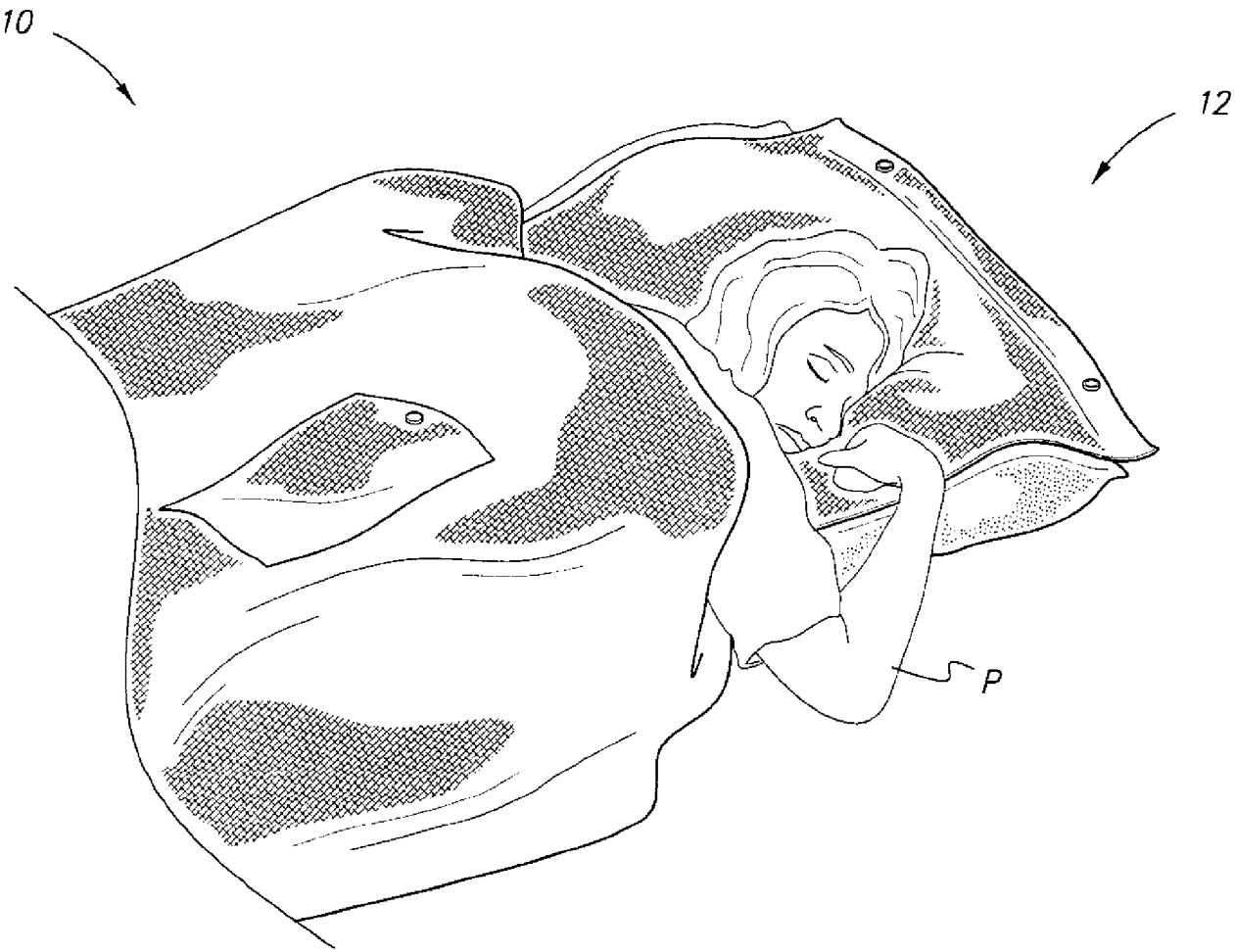
FIG. 1 is an environmental, perspective view of a comfort quilt and pillowcase combination according to the present invention.

As shown in FIG. 1 the comfort quilt and pillowcase, generally, designated as 10 and 12, respectively, are adapted to be utilized by a person P who may require a degree of comfort and hope when a caregiver is not immediately available.

Figure 2:
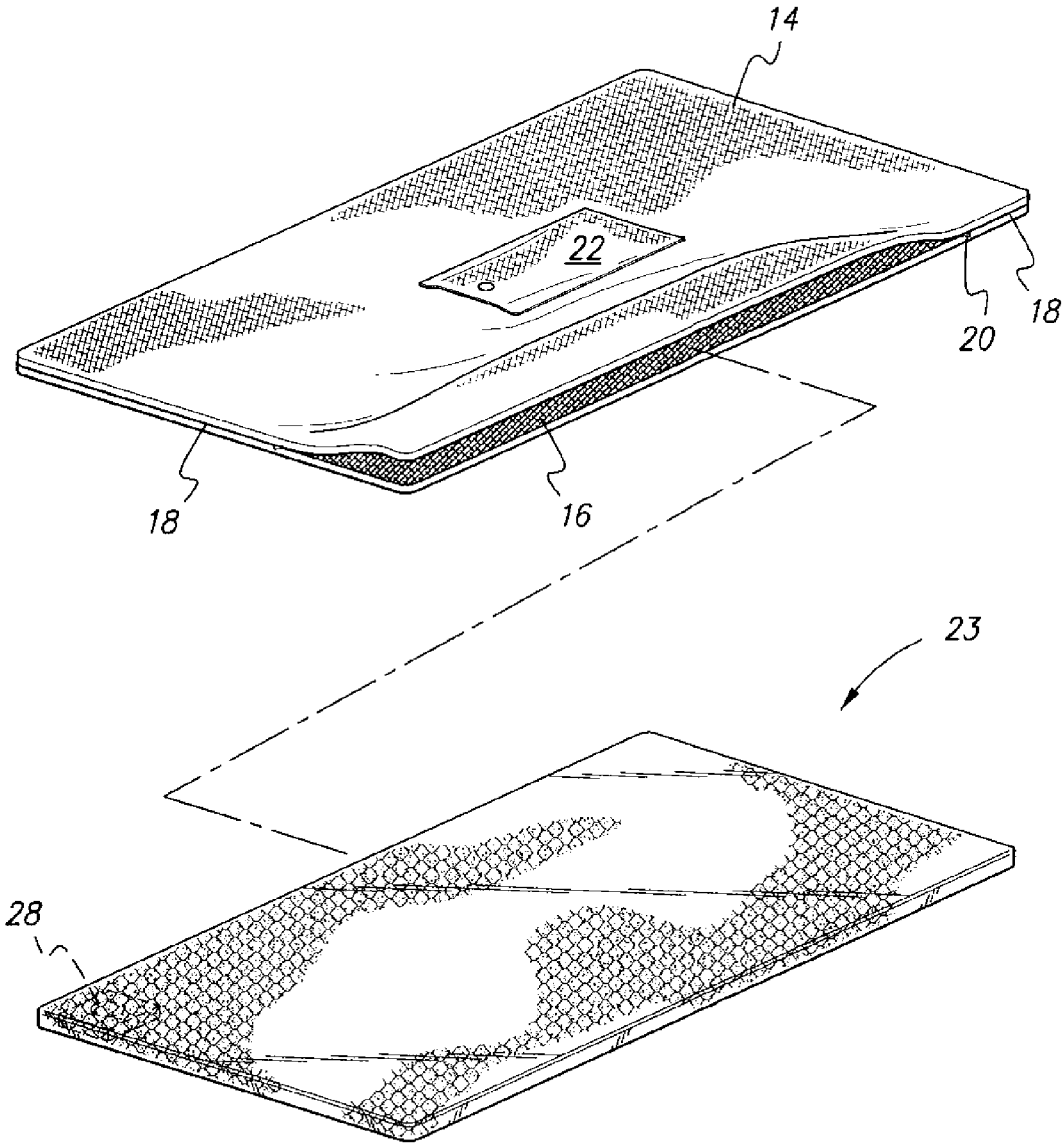
FIG. 2 is an exploded, perspective view of a comfort quilt housing and insert according to the present invention.
Figure 3:
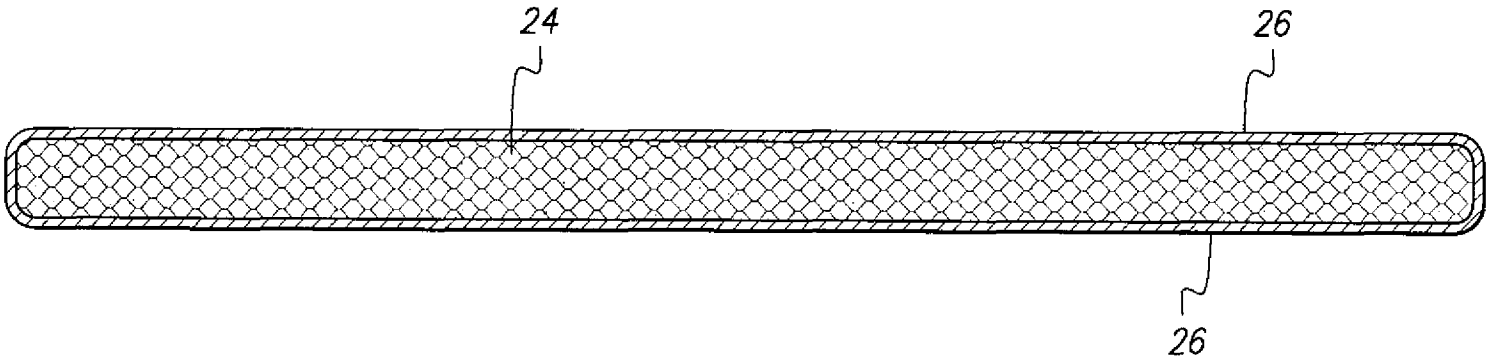
FIG. 3 is an end view in section of the insert of FIG. 2.

Referring to FIGS. 2 and 3, the quilt 10 is shown to comprise a housing having a top panel 14 and a bottom panel 16 connected by side and end walls 18 to form an enclosure. A zipper 20 or similar fastener (buttons, snaps, hook and loop fasteners, etc.) is mounted on the walls 18 to provide means to open and close the housing. The panels 14, 16 and walls 18 are fabricated from soft and supple quality materials (wool, cotton. synthetics, blends, etc.). A closable pocket 22 is centered on the outer surface of panel 14 for containing small items that will be readily available when wanted or needed. A quilt insert member, generally designated at 23, consists of a soft material 24, such as cotton, that is encapsulated and sealed within a plastic sheathing 26. The insert member 23 provides additional insulation to the quilt 10 and adds body thereto. An electronic playback and sound-producing device 28 is positioned and secured in an upper corner of the insert member 23. A button or the like can be manipulated to control the device 28. As presently contemplated, the quilt housing may be about 42" wide and 62" long. Although these dimensions are preferred, it is recognized that the housing could be made in smaller or larger sizes if desired. The insert 23 will be made with slightly smaller dimensions so that it can be easily accommodated within the housing.

Figure 4:
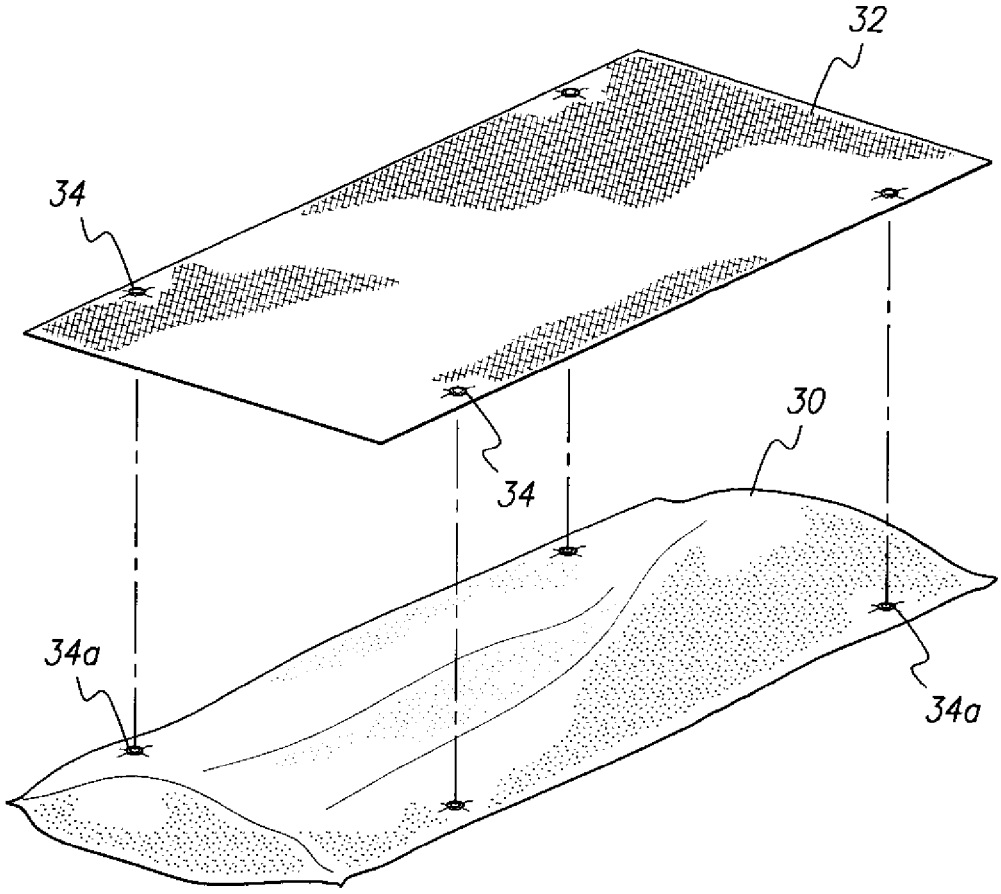
FIG. 4 is an exploded, perspective view of a pillowcase and facing according to the present invention.

As best seen in FIG. 4, the pillowcase 12 comprises a pillow housing 30 having an outer surface area provided with snap fasteners 34*a* positioned adjacent each corner thereof. A facing panel 32 is provided with snap fasteners 34 positioned to mate with fasteners 34*a*. This arrangement permits the facing panel 32 to be easily removed when it is soiled. The area defined by facing panel 32 is substantially coextensive with the area defined by the outer surface of the pillow housing 30. Facing panel 32 and pillow housing 30 will be made from a good, suitable fabric and may be coordinated (color, fabric, etc.) for aesthetic purposes.

It is to be understood that the present invention is not limited to the embodiments described above, but encompasses any and all embodiments within the scope of the following claims.

I claim:

1. A comfort bedding set, comprising:

a comfort quilt having a housing, the housing being fabricated from a soft supple material and having a top panel, a bottom panel, sidewalls and end walls, the sidewalls and end walls connecting the top panel to the bottom panel, the sidewalls having an opening defined therein, the top panel having an outer surface;

an insert member insertable through the opening in the sidewalls so that the insert member is removably positioned in the housing and being substantially coextensive therewith, wherein the insert member includes a plastic sheathing entirely enveloping a soft material sealed within the plastic sheathing;

a fastener on the sidewalls for optionally closing the opening in the sidewalls;

a pillowcase; and a removable facing panel attached to the pillowcase, wherein the pillow case has an outer surface defining an area and having a first plurality of fasteners on the outer surface and the removable facing panel has an area substantially coextensive with the area of the outer surface and a second plurality of fasteners positioned on the removable facing panel for mating with the first plurality of fasteners.

2. The comfort bedding set according to claim 1, wherein said insert comprises:

an electronic playback and sound producing device sealed within the plastic sheathing.

3. The comfort bedding set according to claim 1, further comprising a closable pocket positioned on the outer surface of the top panel of the housing.

4. The comfort bedding set according to claim 1, wherein the fastener for the housing sidewalls is a zipper.

* * * * *